US006051541A

United States Patent [19]

Neuser et al.

[11] Patent Number: 6,051,541

[45] Date of Patent: Apr. 18, 2000

[54] PROCESS FOR PREPARING POURABLE, TRANSPARENT/TRANSLUCENT LIQUID DETERGENT WITH CONTINUOUS SUSPENDING SYSTEM

[75] Inventors: Kristina Marie Neuser, Cliffside Park; Myongsuk Bae-Lee, Montville; Feng-Lung Gordon Hsu, Tenafly; Daniel Joseph Kuzmenka, Wood-Ridge; Dennis Stephen Murphy, Leonia, all of N.J.

[73] Assignee: Unilever Home & Personal Care, Division of Conopco, Inc., Greenwich, Conn.

[21] Appl. No.: 09/212,981

[22] Filed: Dec. 16, 1998

[51] Int. Cl.[7] ..... C11D 3/22; C11D 3/37

[52] U.S. Cl. ..... 510/337; 510/405; 510/397; 510/418; 510/462; 510/470; 510/471

[58] Field of Search ..... 510/418, 470, 510/471, 337, 405, 462, 397

[56] References Cited

U.S. PATENT DOCUMENTS

| | | | |
|---|---|---|---|
| 2,379,942 | 7/1945 | Webber | 439/89 |
| 2,503,280 | 4/1950 | Lockwood | 562/121 |
| 2,507,088 | 5/1950 | Bradley | 526/121 |
| 3,060,124 | 10/1962 | Ginn | 252/135 |
| 3,260,741 | 7/1966 | Mackinnon et al. | 562/121 |
| 3,308,067 | 3/1967 | Diehl | 510/346 |
| 3,372,188 | 3/1968 | Alston et al. | 562/121 |
| 3,630,929 | 12/1971 | Van Dijk | 510/413 |
| 4,062,647 | 12/1977 | Storm et al. | 8/137 |
| 4,090,973 | 5/1978 | Maguire, Jr. et al. | 510/393 |
| 4,260,528 | 4/1981 | Fox et al. | 252/525 |
| 4,316,812 | 2/1982 | Hancock et al. | 510/304 |
| 4,474,818 | 10/1984 | Scott | 514/777 |
| 4,489,512 | 12/1984 | Schovee | 40/700 |
| 4,497,718 | 2/1985 | Neiditch et al. | 510/516 |
| 4,556,510 | 12/1985 | Holsopple | 252/547 |
| 4,749,512 | 6/1988 | Broze et al. | 510/304 |
| 5,047,167 | 9/1991 | Steyn et al. | 252/160 |
| 5,057,241 | 10/1991 | Merrit et al. | 252/174.17 |
| 5,147,576 | 9/1992 | Montague et al. | 510/417 |
| 5,281,355 | 1/1994 | Tsaur et al. | 510/393 |
| 5,281,356 | 1/1994 | Tsaur et al. | 510/393 |
| 5,393,450 | 2/1995 | Shana'a | 252/170 |
| 5,494,602 | 2/1996 | Thomaides et al. | 510/417 |
| 5,534,265 | 7/1996 | Fowler et al. | 424/489 |
| 5,562,939 | 10/1996 | Lewis | 426/250 |
| 5,589,370 | 12/1996 | Ratuiste et al. | 264/4.3 |
| 5,597,790 | 1/1997 | Thoen | 510/303 |
| 5,733,854 | 3/1998 | Chowdhary et al. | 510/121 |
| 5,750,484 | 5/1998 | Falbaum et al. | 510/276 |
| 5,853,430 | 12/1998 | Shindo et al. | 8/137 |
| 5,880,076 | 3/1999 | Vermeer | 510/123 |

FOREIGN PATENT DOCUMENTS

| | | |
|---|---|---|
| 258062 A2 | 3/1988 | European Pat. Off. . |
| 401413 | 11/1933 | United Kingdom . |
| 461221 | 2/1937 | United Kingdom . |
| 1303810 | 1/1973 | United Kingdom . |
| 1429143 | 3/1976 | United Kingdom . |
| 1470250 | 4/1977 | United Kingdom . |
| 97/26315 | 7/1997 | WIPO . |

*Primary Examiner*—Kery Fries
*Assistant Examiner*—Dawn Garrett
*Attorney, Agent, or Firm*—Neil Y. Gilbert, Esq.

[57] ABSTRACT

A translucent/transparent composition capable of suspending relatively large size particles while remaining readily pourable. The composition is stable, even in presence of readily large amount of electrolyte/surfactant.

11 Claims, No Drawings

PROCESS FOR PREPARING POURABLE, TRANSPARENT/TRANSLUCENT LIQUID DETERGENT WITH CONTINUOUS SUSPENDING SYSTEM

FIELD OF INVENTION

The present invention relates to a process for manufacturing transparent or translucent heavy duty liquid laundry detergent compositions containing polymer or polymers (e.g., polymer gums) capable of suspending relatively large size particles while remaining readily pourable (good shear thinning properties). The suspended particles generally comprise a component subject to degradation (e.g., encapsulated enzyme and/or bleach) and/or a component not soluble in heavy duty liquid and which causes opaque appearance. Through careful selection of polymer/polymers, it is possible to find a polymer suspending system stable in ionic (e.g., high surfactant) environment and which simultaneously provides consumer desirable appearance. Through unique processing of polymer(s), the above noted properties can be achieved. In particular, the present invention is concerned with the formation of a continuous network suspending system.

BACKGROUND OF THE INVENTION

For a variety of reasons, it is often greatly desirable to suspend particles in heavy duty liquid detergent compositions. For example, because there are certain components (e.g., bleaches, enzymes, perfumes) which readily degrade in the hostile environment of surfactant containing heavy duty liquids, these components can be protected in capsule particles (such as described, for example, in U.S. Pat. Nos. 5,281,355 and 5,281,356, both to Tsaur et al., hereby incorporated by reference into the subject application) and the capsule particles may be suspended in the heavy duty liquid detergents. Other particles which may be suspended include enzymes (whether or not encapsulated) and desirable polymers (e.g., aminosilicone oil, PVP, soil release agent, antideposition agents, antiwrinkle agents etc.)

One way to suspend particles in liquid compositions is to use so-called "structured" heavy duty liquids (sometimes referred to in the art as "duotropic" liquids, and in contrast to single continuous phase "isotropic" liquids). Structured liquids may be broadly characterized in that they contain high levels of electrolyte and in that the liquids form so-called lamellar layers which are like sheets or plates in close proximity to one other. Structured liquids are well defined in U.S. Pat. No. 5,147,576 to Montague et al., hereby incorporated by reference into the subject application. Such structured liquids, by virtue of their close packing and lamellar sheets, are generally able to suspend particles (e.g., capsules, enzymes, polymers) more readily than isotropic liquids. Structured liquids are often difficult to pour and because they are lamellar, are generally, if not always, opaque.

Another way of suspending particles in liquids is through the use of certain structuring gums (e.g., xanthan gum, rhamsan gum and the like). While such gums are desirably used to structure liquids and suspend particles, however, they are notoriously susceptible to electrolytes (e.g., surfactants, electrolyte) present in the compositions and so may generally only be used when the level of surfactant is severely limited (e.g., less than 10% by wt.). By contrast, compositions of the present invention comprise greater than 20%, more preferably 21–85% by wt. surfactant. Use of polymer gums and such levels of surfactant is known to lead to instability precipitation which in turn leads to non-clear product and phase separation).

Moreover, when used to thicken compositions, the gum polymers are generally used in such high amounts as to render the compositions very difficult to pour. By difficult to pour is meant less than about 3000 cps at 21 $S^{-1}$ shear rate measured at room temperature (measurements of invention were made using Haake RV20 Rotovisco RC20 Rheocontroller; preferred sensor systems were MV1, MV2 and MV3 sensor systems).

As far as applicants are aware, all attempts to suspend particles, particularly large size particles (e.g., 300 to 5000 microns, preferably 500 or greater to 3000 microns), in liquid compositions, particularly those containing greater than 20% surfactant, while maintaining pourability have been unsuccessful.

U.S. Pat. No. 4,489,512 to Brown et al., for example, teaches suspension of builder salts in automatic dishwashing formulations. The compositions are neither translucent nor transparent. The compositions also contain no water and no polymeric thickeners. The builders are suspended due to surfactant structuring.

U.S. Pat. No. 5,562,939 to Lewis teaches a method using a pre-gel process to suspend particles in liquid. The compositions have no surfactant and a pH of 2.5 to 6, preferably 3.0 compared to much higher surfactant levels and pH (about 8 to 12, preferably 6 to 13), of the subject invention.

U.S. Pat. No. 5,597,790 to Thoen teaches suspension of solid peroxygen compounds having particle size of 0.5 to 20 microns in liquid detergents using low levels of silicate. The suspended particles were much smaller than those of the invention.

Finally GB 1,303,810 discloses clear liquid medium and a visually distinct component of at least 0.5 millemeter particle size. However where more than 10% surfactant is used, only clays, not gums are used to structure. Where a gum is used to structure (Kelzan), no more than 10% surfactant is used.

In short, there is no teaching in the art of heavy duty liquid compositions containing greater than 20%, preferably about 21% to 85% surfactant comprising suspending gum polymers stable in high surfactant environment (e.g., don't phase separate and cause opaqueness) able to suspend large size particles and simultaneously provide translucent/transparent, pourable compositions.

While not wishing to be bound by theory, it is believed these compositions can be formed only because of applicants realization that the suspending polymers (e.g.. gums) must be given sufficient time or heat to swell, preferably while not in the presence of surfactant or electrolyte (e.g., surfactant or electrolyte will compete for water preventing water gain by gum).

Once said polymer solution is formed, all nonionic components and optionally water are next added. Water is added as part of the polymer gum solution and/or as part of base detergent composition. Only then are ionic components (e.g., electrolyte, anionic surfactants) added to the solution. It should be understood that minute or insubstantial amounts (less than 5%, more preferably less than 1%) of ionic component may be included as raw ingredients.

In any event, because a pre-swollen polymer gum solution is first formed without substantial surfactant/ionic competition, surprisingly and unexpectedly it has been found possible to form a transparent/translucent liquid detergent system which suspends large size particles and is readily pourable. Moreover, the suspending polymers are not susceptible to ionic agents (e.g., surfactants) and can form these continuous suspending network function in a high surfactant environment. This is completely novel to the art as far as applicants are aware.

The subject invention is directed to selection of specific gum and formation of continuous, network suspending systems while a companion case is directed to selection of specific gums to form a "non-continuous" suspending network.

BRIEF DESCRIPTION OF THE INVENTION

The present invention provides a process for manufacturing an easily pourable (high shear thinning), transparent or translucent heavy duty liquid composition capable of suspending particles (e.g., capsules) in the range of 300 to 5000 microns in size, even in the presence of high surfactant concentration. The process comprises;

(1) first forming a gum solution (i.e., premix) by mixing 0.01 to 10%, preferably 0.05 to 5% by wt. of gum premix of certain suspending polymer gums (e.g., gellan, xanthan gum) with water from a temperature of about room temperature to about 200° F. for at least 30 minutes or until gum is fully swollen depending on gum selection (for hygiene purposes it is preferable to heat to at least 150° F. for at least 30 minutes) in order to form a polymer gum premix having concentration of 0.001 to 5% for a total composition;

(2) subsequently adding all nonionic components (e.g., nonionic surfactants) and optionally additional water to said polymer gum premix; and (3) subsequently adding all ionic compounds to said polymer solution.

It should be understood that it may be possible to add small amounts (less than 5%, preferably less than 3%, more preferably less than 1%) of ionic components without precipitating, but for purposes of invention, substantially all nonionic is added and then substantially all ionic.

DETAILED DESCRIPTION OF THE INVENTION

The invention comprises a specific process for making an easy pouring, transparent or translucent heavy duty liquid composition wherein a polymer or polymer gums are used to stably suspend relatively large size particles, even in the presence of relatively large amount of surfactant/electrolyte/builder.

In particular, the invention is directed to specific gums (e.g., xanthan gum, gellan) and combinations of these gums with other materials which will form a so-called "continuous" network wherein the gum molecular form continuous interlocking "strands" which weave to form a suspending system capable of suspending particles (e.g., capsule) of 300 to 5000 microns in size.

Moreover, because of the unique way in that the systems are formed (e.g., formation of polymer gum solution from polymer and water in substantial absence of surfactant competition for water), the suspending network is highly resistant to surfactant, will not readily precipitate and will form transparent/translucent detergent compositions which are stable to surfactant while remaining readily pourable and stable.

Compositions

The various components of this invention for heavy duty liquid (HDL) detergert compositions are set forth in great detail below.

Suspending Polymers and Polymer Mixtures

Compositions made by the process of this invention contain a polymer or polymer mixture which are capable of suspending relatively large size particles while remaining relatively pourable. Specifically, the polymer or mixture are selected to form a continuous, interlocking network system.

It is well known that polymers that require at least some ionic species to be present as a prerequisite for gel formation are susceptible to destabilization by surfactant whether formed as a continuous network or a non-continuous network of gel "bits". This invention surprisingly found that a polymer or polymer mix capable of forming a network (e.g., in the presence of electrolyte) can be stable in heavy duty liquid detergent compositions with high surfactant concentration (i.e., greater than 20%, preferably 21% to 85%) if prepared in the proper way. This is the case even with some ionic surfactants.

Generally, it is preferred to use larger amounts of nonionic and small amounts of anionic because anionics may be more difficult to stabilize.

In general, the polymer or polymer mixture forming the continuous network of the invention will be of natural origin, specifically one or more polysaccharides. However, it is possible that the polymer, or one or more polymers in a mixture of polymers, might be a chemically modified natural polymer such as a polysaccharide which has been chemically treated to provide or alter substituent groups thereon. It is also conceivable that a polymer mixture might contain a synthetic polymer together with a natural polymer. Usually however, the polymer which is used will include a polysaccharide chain of natural origin.

Examples of gums which may be used are various commercial gums which may be characterized as (1) marine plant; (2) terrestial plants; (3) microbial polysaccharides and (4) polysaccharide derivatives. In addition, gums may include those derived form animal sources (e.g., from skin and/or bones of animals) such as gelatin.

Examples of nonionic plant gums include agar, alginates, carrageenan and furcellaran. Examples of terrestial plant gums include guar gum, gum arabic, gum tragacanth, karaya gum, locust bean gum and pectin. Examples of microbial polysaccharides include dextran, gellan gum, rhamsan gum, welan gum, xanthan gum. Examples of polysaccharide derivatives include carboxymethylcellulose, methyl hydroxypropyl cellulose, hydroxypropyl cellulose hydroxyethyl cellulose, propylene glycol alginate, hydroxypropyl guar and modified starches.

A particularly preferred gum for forming a continuous network is xanthan gum (e.g., Kelzan T from Monsanto Company). Another gum forming such continuous network includes gellan gum.

Because of the process for pre-swelling prior to contact with surfactant and addition of substantially all nonionic species before ionic species, the continuous network formed is stable to surfactant and will not turn opaque.

In another embodiment, the suspending polymer or polymers can be used in combination with cationic polymer such as for example, cationic guar (e.g., Jaguar 162 from Rhone Poulenc), polyquaternium 10 (e.g., Ucare Polymer JR 30M from Americhol Corp.). Ratio is at 5:1 to 100:1 anionic gum to cationic polymer. Suspending polymer/polymer mixtures are generally used in an amount of 0.01 to 3% total polymer, preferably between 0.1 and 0.6% total polymer.

In addition to the continuous gum network, additional thickening agent such as small concentration of other types of structuring agent, including gums may be used. Examples of such accessory structurants include polysaccharide derivatives such as carboxymethylcellulose, methyl hydroxy propyl cellulose etc.

The key to the invention resides in manner in which polymer gums are first contacted with water (prior to any contact with surfactant) and subsequently only nonionic components are added before adding any ionic components.

Detergent Active

The compositions of the invention contains one or more surface active agents (surfactants) selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants. The surfactant must comprise at least 20% by wt. of the composition, e.g., 21% to 85%, preferably 25% to 80% of total composition.

Nonionic Surfactant

Nonionic synthetic organic detergents which can be used with the invention, alone or in combination with other surfactants, are described below.

As is well known, the nonionic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is, 12 to 13 and the number of ethylene oxide groups present averages about 6.5. The higher alcohols are primary alkanols.

Other useful nonionics are represented by the commercially well-known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{,3}$–$C_{15}$ fatty alcohol condensed with 5 moles propylene oxide and 10 moles ethylene oxide, or mixtures of any of the above.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 23-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 7 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R'O—_y(Z)_x$$

wherein R is a monovalent organic radical containing from about 6 to about 30 (preferably from about 8 to about 18) carbon atoms; R' is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1.5 to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1 to 4).

Nonionic surfactants particularly useful for this application include, but are not limited to: alcohol ethoxylates (e.g. Neodol 25-9 from Shell Chemical Co.), alkyl phenol ethoxylates (e.g. Tergitol NP-9 from Union Carbide Corp.), alkylpolyglucosides (e.g. Glucapon 600CS from Henkel Corp.), polyoxyethylenated polyoxypropylene glycols (e.g. Pluronic L-65 from BASF Corp.), sorbitol esters (e.g. Emsorb 2515 from Henkel Corp.), polyoxyethylenated sorbitol esters (e.g. Emsorb 6900 from Henkel Corp.), alkanolamides (e.g. Alkamide DC212/SE from Rhone-Poulenc Co.), and N-alkypyrrolidones (e.g. Surfadone LP-100 from ISP Technologies Inc.).

Nonionic surfactant is preferably used in the formulation from about 3% to about 85%, more preferably between 6% and 40%. It is generally preferred to have excess of nonionic to anionic (i.e., ratio of nonionic to anionic is generally preferred to be greater than 1:1).

Mixtures of two or more of the nonionic surfactants can be used.

Anionic Surfactant Detergents

Anionic surface active agents which may be used in the present invention are those surface active compounds which contain a long chain hydrocarbon hydrophobic group in their molecular structure and a hydrophilic group, i.e.; water solubilizing group such as sulfonate or sulfate group. The anionic surface active agents include the alkali metal (e.g.

sodium and potassium) water soluble higher alkyl benzene sulfonates, alkyl sulfonates, alkyl sulfates and the alkyl polyether sulfates. They may also include fatty acid or fatty acid soaps. The preferred anionic surface active agents are the alkali metal, ammonium or alkanolamide salts of higher alkyl benzene sulfonates and alkali metal, ammonium or alkanolamide salts of higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the C10 to C18 primary normal alkyl sodium and potassium sulfonates, with the C10 to C15 primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 0.05 to 25% and more preferably 0.1 to 10% by weight.

The alkali metal sulfonate can be used in admixture with the alkylbenzene sulfonate in an amount of 0 to 70%, preferably 10 to 50% by weight.

Also normal alkyl and branched chain alkyl sulfates (e.g., primary alkyl sulfates or secondary alcohol sulfates) may be used as the anionic component).

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R'—O(CH_2CH_2O)_p—SO_3M,$$

where R' is $C_8$ to $C_{20}$ alkyl, preferably $C_{10}$ to $C_{18}$ and more preferably $C_{12}$ to $C_{15}$; P is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, alkyl sulfonates, or alkyl sulfates.

The alkali metal higher alkyl poly ethoxy sulfate can be used with the alkylbenzene sulfonate and/or with an alkyl sulfonate or sulfonate, in an amount of 0 to 70% by wt., preferably 0.05 to 25%, more preferably 0.1 to 10% by weight of entire composition.

Anionic surfactants particularly useful for this application include, but are not limited to: linear alkyl benzene sulfonates (e.g. Vista C-500 from Vista Chemical Co.), alkyl sulfates (e.g. Polystep B-5 from Stepan Co.), polyoxyethylenated alkyl sulfates (e.g. Standapol ES-3 from Stepan Co.), alpha olefin sulfonates (e.g. Witconate AOS from Witco Corp.), alpha sulfo methyl esters (e.g. Alpha-Step MC48 from Stepan Co.) and isethionates (e.g. Jordapon Cl from PPG Industries Inc.).

Anionic surfactant is used in the formulation from about 0% to about 25%, preferably between 0.1% and 10%.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic detergents can be broadly described as derivatives of aliphatic or aliphatic derivatives of heterocyclic secondary and tertiary amines in which the aliphatic radical may be a straight chain or a branched and wherein one of the aliphatic substituents contains from about 8 to 18 carbon atoms and at least one contains an anionic water-solubilizing group, e.g. carboxy, sulfonate, sulfate. Examples of compounds falling within this definition are sodium 3(dodecylamino)propionate, sodium 3-(dodecylamino)propane-1-sulfonate, sodium 2-(dodecylamino)ethyl sulfate, sodium 2-(dimethylamino)

octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of amphoteric active used may vary from 0 to 25% by weight, preferably 1 to 15% by weight.

It should be noted that the compositions of the invention are preferably isotropic and either transparent or translucent.

Total surfactant used will be at least 20%, preferably at least 23%, more preferably 25% by wt. and higher.

Builders/Electrolyte

Builders which can be used according to this invention include conventional alkaline detergency builders, inorganic or organic, which can be used at levels from about 0% to about 50% by weight of the composition, preferably from 1% to about 35% by weight.

As used herein, the term electrolyte means any water-soluble salt.

Preferably the composition comprises at least 1.0% by weight, more preferably at least 5.0% by weight, most preferably at least 10.0% by weight of electrolyte. The electrolyte may also be a detergency builder, such as the inorganic builder sodium tripolyphosphate, or it may be a non-functional electrolyte such as sodium sulfate or chloride. Preferably the inorganic builder comprises all or part of the electrolyte.

Although no electrolyte is required, preferably at least 1% electrolyte is used, more preferably 3% to as much as about 50% by weight electrolyte.

The compositions of the invention are capable of suspending particulate solids,, although particularly preferred are those systems where such solids are actually in suspension. The solids may be undissolved electrolyte, the same as or different from the electrolyte in solution, the latter being saturated in electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used are water-soluble alkali metal phosphates, polyphosphates, borates, silicates and also carbonates. Specific examples of such salts are sodium and potassium triphosphates, pyrophosphates, orthophosphates, hexametaphosphates, tetraborates, silicates, and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)- nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetra-phosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TPS).

Certain zeolites or aluminosilicates can be used. One such aluminosilicate which is useful in the compositions of the invention is an amorphous water-insoluble hydrated compound of the formula $Na_x[(AlO_2)_y.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 mm to about 5 mm. This ion exchange builder is more fully described in British Pat. No. 1,470,250.

A second water-insoluble synthetic aluminosilicate ion exchange material useful herein is crystalline in nature and has the formula $Na_z[(AlO_2)_y(SiO_2)]_xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 mm to about 100 mm; a calcium ion exchange capacity on an anhydrous basis of at test about 200 milligrams equivalent of $CaCO_3$ hardness per gram; and a calcium exchange rate on an anhydrous basis of at least about 2 grains/gallon/minute/gram. These synthetic aluminosilicates are more fully described in British Pat. No. 1,429,143.

Enzymes

Enzymes which may be used in the subject invention are described in greater detail below.

If a lipase is used, the lipolytic enzyme may be either a fungal lipase producible by *Humicola lanuginosa* and *Thermomyces lanuginosa* or a bacterial lipase which show a positive immunological cross-reaction with the antibody of the lipase produced by the microorganism *Chromobacter T viscosum* var. *lipolyticum* NRRL B-3673. This microorganism has been described in Dutch patent specification 154, 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., U.S.A., under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immune diffusion procedure according to Ouchterlony (Acta. Med. Scan., 133. pages 76–79 (1930).

The preparation of the antiserum is carried out as follows:

Equal volumes of 0.1 mg/ml antigen and of Freund's adjuvant (complete or incomplete) are mixed until an emulsion is obtained. Two female rabbits are injected 45 with 2 ml samples of the emulsion according to the following scheme:

day 0: antigen in complete Freund's adjuvant
day 4: antigen in complete Freund's adjuvant
day 32: antigen in incomplete Freund's adjuvant
day 64: booster of antigen in incomplete Freund's adjuvant.

The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchteriony procedure. A dilution of antiserum was the dilution that still gave a visible precipitation with an antigen concentration of 0.1 mg/ml.

All bacterial lipases showing a positive immunological cross reaction with the TJ-lipase antibody as hereabove described are lipases suitable in this embodiment of the invention. Typical examples thereof are the lipase 63 ex *Pseudomonas fluorescens* IAM 1057 (available from Amano Pharmaceutical Co., Nagoya, Japan, under the trade-name Amano-P lipase), the lipase ex *Pseudomonas fragi* FERM P 1339 (available under the trade-name Amano B), the lipase ex *Pseudomonas nitroreducens* var. *lipolyticum* FERM P1338, the lipase ex Pseudomonas sp. (available under the trade-name Amano CES), the lipase ex *Pseudomonas cepacia*, lipases ex *Chromobacter viscosum*, e.g. *Chromobacter viscosum* var. *lipolyticum* NRRL B-3673, commercially available from Toyo Jozo Co., Tagata, Japan; and further *Chromobacter viscosum* lipases from U.S. Biochemical Corp. U.S.A. and Diosynth Co., The Netherlands, and lipases ex *Pseudomonas gladioli.*

An example of a fungal lipase as defined above is the lipase ex *Humicola lanuginosa* available from Amano under the tradename Amano CE; the lipase ex *Humicola lanuginosa* as described in the aforesaid European Pat. Application 0,258,068 (NOVO), as well as the lipase obtained by cloning the gene from *Humicola lanuginosa* and expressing this gene in *Aspergillus oryzae*, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

A Lipase Unit (LU) is that amount of lipase which produces 1/mmol of titratable fatty acid per minute in a pH state under the following conditions: temperature 30° C.; pH=9.0; substrate is an emulsion of 3.3 wt. % of olive oil and 3,3% gum arabic, in the presence of 13 mmol/l $Ca^{2+}$ and 20 mmol/l NaCl in 5 mmol/l Trisbuffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B. licheniformis*. Examples of suitable commercially available proteases are Alcalase, Savinase, Esperase, all of NOVO Industri A/S; Maxatase and Maxacal of Gist-Brocades; Kazusase of Showa Denko; BPN and BPN' proteases and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any Fray be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with cofactors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym from Novo.

Optional Ingredients

In addition to the enzymes mentioned above, a number of other optional ingredients may be used.

Alkalinity buffers which may be added to the compositions of the invention include monoethanolamine, triethanolamine, borax, sodium silicate and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 30% montmorillonite and thus its cation exchange capacity is at least about 50 to 75 meg per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Pat. No. 401,413 to Marriott and British Pat. No. 461,221 to Marriott and Guam.

In addition, various other detergent additives of adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose, A preferred anti-redeposition agent is sodium carboxylmethyl cellulose having a 2:1 ratio of CM/MC which is sold under the tradename Relatin DM 4050.

Another minor ingredient is soil releasing agents, e.g. deflocculating polymers. In general, a deflocculating polymer comprises a hydrophilic backbone and one or more hydrophobic side chains.

The deflocculating polymer of the invention is described in greater detail in U.S. Pat. No. 5,147,576 to Montague et al. hereby incorporated by reference into the subject application.

The deflocculating polymer generally will comprise, when used, from about 0.1 to about 5% of the composition, preferably 0.1 to about 2% and most preferably, about 0.5 to about 1.5%.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

Optionally, the inventive compositions may contain all or some the following ingredients: zwitterionic surfactants (e.g. Mirataine BET C-30 from Rhone-Poulenc Co.), cationic surfactants (e.g. Schercamox DML from Scher Chemicals, Inc.), fluorescent dye, antiredeposition polymers, antidye transfer polymers, soil release polymers, protease enzymes, lipase enzymes, amylase enzymes, cellulase enzymes, peroxidase enzymes, enzyme stabilizers, perfume, opacifiers, UV absorbers, builders, and suspended particles of size range 300–5000 microns.

Structure Formation

In most polymer-structured systems, the polymers are forming a continuous network through the system. But the polymers in these types of systems are prone to the dehydration or salting out effect. These polymers include families of Xanthan gum, polyacrylates, etc.

For example, as stated in "Xanthan Gum: Natural Biogum for scientific water control", 5th edition, hereby incorporated by reference in the subject application, biological polymers solutions, especially xanthan gum, are typically stable up to 20% nonionic or 15% anionic surfactant alone. Combinations of any amount of nonionic with any amount of anionic lead to instability such that it is clear that the art teaches that no more than 20% surfactant total can be stably produced.

Surprisingly, applicants have discovered that one can construct a system with a continuous network to form a highly shear-thinning rheological property and maintain a high degree of transparency. In addition, it has been found that through processing, one can drastically increase the upper limit of surfactant tolerance in the polymer network.

More specifically, the process of the invention comprises first forming a polymer gum solution by mixing 0.01 to 10% by wt. (of gum solution) of a specific polymer gum/gel which will form a continuous network when polymers interact in final solution.

Specific polymers which may form such continuous network include xanthan gum, gellan gum or pectin.

Once the polymer gel solution is formed, only nonionic components should be added to solution. The nonionic components may be added one at a time or as a premix and are added at a temperature of room temperature to about 200° F. for at least 5 to 10 minutes. Agitation is preferably used although not required.

Finally, after desired nonionic components are added, ionic components are added Again this may be added either one at a time or a premix and are added at room temperature to 200° F., preferably with agitation for at least 5 to 20 minutes.

By separately adding substantially all nonionic components before substantially all ionic ones, the continuous network formed is much more tolerant to surfactant and minor ingredients in final solution.

Flow Properties

The pouring viscosity of the present aqueous liquid detergent composition can be in the range of 50 to 3000 centipoises, preferably 100 to 2000, more preferably 150 to 1500 centipoises. The pouring viscosity is measured at shear rate of 21 1/sec measured at temperature of about 25° C. In the subject invention, viscosity was measured using a Haake RV20 Rotoviscometer, RC20 Rheocontroller and Haake F3-C circulators. Either an MV1, MV2 or MV3 sensor system (e.g., cylindrical spindle) was used for measurements. At the viscosities mentioned, the liquid detergent is easily pourable. The present aqueous liquid detergent composition is a stable dispersion/emulsion and can suspend 300 to 5000 micron particles.

The compositions of the invention have at least about 50% transmittance of light using 1 centimeter cuvette at a wavelength of 410–800 nm, preferably 570–690 nanometers, wherein the composition is measured in absence of dies.

Alternatively, transparency of the composition may be measured as having an absorbency in the visible light wavelength (about 410 to 800 nm) of less than 0.3 which is in turn equivalent to at least 50% transmittance using cuvette and wavelength noted above. For purposes of the invention, as long as one wavelength in the visible light range has greater than 50% transmittance, it is considered to be transparent/translucent.

One of the properties of the compositions of the invention is that it contains gums which have been pre-swollen (with water) because, it is believed the gum is able to absorb water when not in the presence of surfactant and/or electrolyte and thus does not have to compete with the surfactant and/or electrolyte for available water.

There are a variety of ways that can be used for testing how swollen a gum (or other material) has gotten. These include the use of dyes or other indicators (e.g., toluidine blue 0; methylene blue one iodine). By applying the indicator, the degree of swelling (due to water) of a given gum polymer may be readily observed.

Physical Properties

The compositions pertaining to this invention exhibit several special characteristics in rheology, transmittance and storage stability.

Rheological Properties

Consumers tend to prefer a thick liquid detergent product but also require that the products pour easily. These two contradictory requirements only can be achieved by creating a formulation that has a highly shear thinning behavior. This means that at pouring stage (scientifically defined at about the shear rate of 21 1/sec), the viscosity value of liquid detergent formulations should be less than 3,000 cp and preferably less than 1,500 cp. At the viscosities mentioned, liquid detergent is readily pourable.

The aqueous liquid detergent composition can suspend 300 to 5000 microns particles for at least 2 weeks, preferably at least 3 weeks, more preferably at least 5 weeks at room temperature.

Suspended Particles

Technically, it is well known in the art that heavy duty liquid detergents provide a hostile environment for desirable ingredients such as, for example, bleaches, enzymes and perfumes. Components which are sensitive to the ingredients found in the compositions (e.g., enzymes in detergent compositions, particularly concentrated detergent compositions, are denatured by surfactants in the detergent composition) can be encapsulated and protected until they are ready for release. Some types of encapsulated enzyme capsules are disclosed in U.S. Pat. No. 5,281,355 to Tsaur et al. and U.S. Pat. No. 5,589,370 to Ratuiste et al. Commercial enzyme granules originally designed for powder detergent, such as Purafect 3100G, can also be used in this application.

Components which are simply more desirably released later in the wash (e.g., perfumes, fabric softening agents or anti-foams) can be encapsulated and controllably released, for example, by dilution of a concentrated liquid.

Other components, such as anti-redeposition agent CP-5 polymer or builder zeolite are not dissoluble in isotropic heavy duty liquid detergent compositions. These fine, insoluble particles cause the opaqueness of products. To prevent the opaqueness, these fine particle components can be pre-granulated and post dosed as suspended particles.

Liquid components that are immiscible with liquid detergent compositions, such as amino silicone and silicone defoamer can be incorporated as encapsulates. Functional polymers including color protecting polymers, fabric protection polymers and soil release polymers, such as PVP (polyvinylpyrrolidone), Narlex DC-1 ex National Starch (e.g., polyacrylate/methacrylate copolymer) and that can be salted out due to the high electrolyte concentration in liquid detergent compositions also can be incorporated in an encapsulated form.

In particular, it is desirable to encapsulate one or more enzymes since enzymes are highly efficient laundry washing ingredients used to promote removal of soils and stains during the cleaning process. Furthermore, it is also desirable to encapsulate bleach and enzymes separately to further enhance detergent efficacies.

Aesthetically, inclusion of suspended particles in the liquid produces a product form not previously seen in the HDL category by consumers which may be appealing. Thus, particles that do not contain any detergent ingredients may be also used in this application.

The size of the suspended particles used in this application is in the range of 300 to 5000 microns, preferably 500 to 2500 microns, and most preferably 700 to 2000. The density should be in the range of 0.8 to 3 g/cm$^3$, preferably in the range of 0.9 to 1.8 g/cm$^3$, and most preferably in the range of 0.95 to 1.20 g/cm$^3$.

EXAMPLES

The following examples are intended to further illustrate and describe the invention and are not intended to limit the invention in any way.

Examples A–D—Preparation of Suspended Capsules

Several types of capsules were prepared in the lab to use for suspending and storage studies. The composition variations are shown in Table 1.

TABLE 1

| Raws | Example A, g | Example B, g | Example C, g | Example D, g |
|---|---|---|---|---|
| Deionized water | 2820.00 | 98.00 | 32.20 | 29.40 |
| K-carrageenan gum | 60.00 | 2.00 | 0.80 | 0.60 |
| Zeolite | 90.00 | 0.00 | 4.00 | 2.00 |
| white pigment | 30.00 | 0.00 | 0.00 | 0.00 |
| 30% PVP solution | 0.00 | 40.00 | 40.00 | 20.00 |
| Fluorescent dye | 0.00 | 1.00 | 0.00 | 0.00 |

PVP = polyvinylpyrrolidone

Specifically, Kappa-carrageenan gum powder and water were mixed and heated to 160° F. until the gum was well dispersed and hydrated. Other ingredients were added according to the list of Table 1 and mixing was continued until the ingredients were well mixed. The composition was cooled to room temperature for spraying through a two-fluid nozzle into a 5% KCI hardening solution bath. Capsules were collected and passed through screens of 500 and 2000 microns.

Example E—Preparation of Suspended Capsules

Capsules using gellan gum were also prepared by: a) mixing 1000 g of deionized water, 5 g of Kelcogel LT (gellan gum Ex Monsanto) and 1.5 g of sodium citrate; b) mixing and heating to 180° F. for 30 minutes; c) turning off heat and mixing in 10 g pigment; d) letting cool to room temperature; and e) spraying through two-fluid nozzle into 10% NaCl hardening solution.

Example E typifies the compositions of these type of capsule particles.

| Particles Raws | Kelcogel LT | Water | sodium citrate | Pigment |
|---|---|---|---|---|
| G | 5 | 1000 | 1.5 | 10 |
| Hardening solution Raws | NaCl | Water | | |
| G | 200 | 1800 | | |

Other functional ingredients were added to the gellan capsules similar to ingredients added to kappa-carrageenan capsules of Examples A–D. Other examples of ingredients which can be added to the capsules include PVP, fluorescent dye and silicone oil.

Examples 1 & 2

The composition in the following table relates to both examples 1 and 2.

TABLE 1

Composition of Examples 1 and 2

| Chemical | Composition (%) |
|---|---|
| Neodol 25-7 ex. Shell Chemical* | 25.0 |
| Triethanolamine | 5.0 |
| Xanthan Gum | 0.5 |
| Deionized Water | 69.5 |

*$C_{12}$ to $C_{15}$ alkyl chain ethoxylated with 7 EO groups.

Example 1

Xanthan gum (0.5 grams) was mixed with 69.5 grams of deionized water and agitated for approximately 30 minutes so as to allow full hydration of the gum. To this, 25 grams of Neodol 25-7 was added and mixed until smooth and clear (approximately 5 minutes). Finally, 5 grams of TEA was added and mixed for an additional 5 minutes. The resulting product was transparent and thick but displayed suspending and shear-thinning abilities.

All mixing was done at room temperature.

This example clearly shows that one can stably prepare a transparent composition comprising greater than 20% surfactant and other agents (e.g., triethanolamine) using the process of the invention.

The composition was stable and suspended capsules of Example A for at least four weeks at room temperature. The composition was also readily pourable.

Example 2

Using the sample composition of Example 1, chemicals were processed in a different order. Specifically xanthan gum (0.5 grams) was added to 25 grams deionized water and agitated for approximately 30 minutes to allow full hydration of gum. To this, 25 grams of Neodol 25-7 were added and the mixture was agitated for 25 minutes. The resulting mixture was extremely thick and difficult to agitate and all transparency was lost. 5 grams of TEA and remaining 44.5 grams of deionized water were added and the entire batch was allowed to mix for 15 minutes. While the end sample regained clarity after the final water addition, it was still a great deal thicker and less shear-thinning than the sample in example 1. In addition to a decrease in shear-thinning ability, the process involved a number of high viscosity mixing steps. This makes the process less attractive.

Again, however, the example was stable and suspended capsules of Example A for at least four weeks. The compositions were readily pourable.

Examples 3 & 4 and Comparative A & B

The composition in the following table relates to Examples 3 and 4 and Comparative A & B.

TABLE 2

Composition of Examples 3–6

| | Composition, g |
|---|---|
| Deionized water | 74.5 |
| xanthan gum | 0.5 |
| Neodol 25-7 | 7.0 |
| Alcohol ethoxysulfate (60% active) | 5.0 |

Example 3

Xanthan gum (0.5 grams) was mixed with 74.5 grams of deionized water and agitated for approximately 30 minutes so as to allow full hydration of the gum. To this, 5 grams of alcohol ethoxysulfate was added and mixed until smooth and clear (approximately 5 minutes). Finally, 7 grams of Neodol 25-7 was added and mixed for an additional 5 minutes. The resulting product was transparent and thick but displayed suspending and shear-thinning abilities.

The composition was stable and suspended capsules of Example A for at least four weeks. This example shows that, when process of invention is followed, stability and suspension criteria are met.

Comparative Example A

Xanthan gum (0.5 grams) was mixed with 24.5 grams of deionized water and agitated for approximately 30 minutes so as to allow full hydration of the gum. Separately, the remaining water (50 grams) was combined with 5 grams of alcohol ethoxysulfate and mixed for 10 minutes until clear and smooth. To this, 7 grams of Neodol 25-7 was added and agitated for 5 minutes. Finally, the xanthan gum solution was added and the batch was mixed for 15 minutes. The resulting sample was clear with cloudy strands throughout (i.e., composition became unstable).

This example shows that, when not following process of the invention, unstable compositions will result.

Comparative Example B

Xanthan gum (0.5 grams) was mixed with 24.5 grams of deionized water and agitated for approximately 30 minutes so as to allow full hydration of the gum. Separately, the remaining water (50 grams) was combined with 5 grams of alcohol ethoxysulfate and mixed for 10 minutes until clear and smooth. To this, the xanthan gum solution from above was added and allowed to mix for 20 minutes. After this addition, a stringy substance similar to Comparative A was visible and did not diminish over time. Finally, 7 grams of Neodol 25-7 were added. Stringy appearance did not seem to diminish over time even after 5 hours of mixing. The resulting sample was clear with cloudy strands throughout. Again, this example shows that following different order of addition, unstable compositions result.

Example 4

Xanthan gum (0.5 grams) was mixed with 24.5 grams of deionized water and agitated for approximately 30 minutes so as to allow full hydration of the gum. Separately, the remaining water (50 grams) was combined with 7 grams of Neodol 25-7 and mixed for 5 minutes until smooth. To this, the xanthan gum solution from above was added and mixed for approximately 10 minutes until smooth. Finally, 5 grams of alcohol ethoxysulfate was added and agitated for 5 minutes. The resulting sample was clear, suspending and shear-thinning.

The examples clearly show that gum needs to be added before ionic component (e.g., anionic surfactants).

Examples 5–7

Three liquid detergent compositions are given in Table 3 below.

TABLE 3

| | Example 5,g | Example 6,g | Example 7,g |
|---|---|---|---|
| Deionized water | 66.53 | 48.79 | 56.7 |
| Xanthan gum | 0.47 | 0.21 | 0.30 |
| Neodol 25-7 | 23.00 | 0.00 | 0.00 |
| Tergitol 15-S-7 | 0.00 | 26.50 | 70.00 |
| Triethanolamine | 0.00 | 4.00 | 0.00 |
| Borax | 2.00 | 0.00 | 0.00 |
| Monoethanolamine | 0.00 | 0.00 | 3.00 |
| Polyvinylpyrrolidone | 0.30 | 0.60 | 0.00 |
| Soil release polymer | 0.50 | 1.00 | 0.00 |
| Fluorescent dye | 0.10 | 0.10 | 0.00 |

Tergitol 15-S-7 is a branched $C_{11}$–$C_{15}$ alkyl chain ethoxylated with 7 EO groups.

The general process for preparing the liquid detergent compositions 5–7 in Table 3 was as follows: A xanthan gum premix was prepared by blending xanthan gum with deionized water. Once the mixture was well blended, it was brought up to 180 F. and mixed at that temperature for 30 minutes to ensure hygienic integrity. The xanthan solution was then allowed to cool to room temperature, though this is not necessary to the process. Batches were made on the benchtop using Tekmar stirrers. At this stage, the xanthan gum mixture was a transparent isotropic liquid. The order of addition of raw materials was as presented in Table 3. These ingredients were added directly to the xanthan gum premix and allowed to mix for several minutes to ensure homogeneity in the sample.

Surprisingly, we have found that through this processing route, we are able to greatly increase the total amount of surfactant in the system as well as include a number of other ingredients beneficial to a liquid laundry detergent. While the literature states for xanthan gum that there is a maximum nonionic surfactant tolerance of 20%, we have been able to increase up to about 70% as can be see in example 7.

What is claimed is:

1. A process for making a stable shear-thinning, transparent or translucent liquid laundry detergent compositions comprising, by weight of the composition:

a) about 0.01% to 5% of a polymer gum or polymer gums capable of forming stable, continuous networks selected from the group of gums consisting of xanthan, rhamsan, i-carrageenan, λ-carrageenan, agar and gelatin wherein said stable, continuous networks can suspend particles having a size of 300 to 5000 microns;

b) about 3–85% nonionic surfactant;

c) about 0–25% anionic surfactant;

d) greater than 20% to 80% of combinations of (b) and (c);

wherein by shear thinning is meant being able to support particles 300 to 5000 microns in size while having a pour viscosity of about 50 to about 3000 cps measured at 21 $S^{-1}$ at about room temperature; wherein by stable is meant particles do not phase separate for at least 2 weeks when measured at room temperature;

wherein said process comprises:

(i) forming a gum premix solution by mixing about 0.01 to 10% by wt. of gum premix of said gum polymer or polymers with balance water at a temperature of about room temperature to about 200° F. for at least 30 minutes or until the polymer is swollen to form a polymer gum premix having a concentration of about 0.001 to 5% by wt. composition;

(ii) subsequent adding all nonionic components and optionally water to said polymer gum premix; and (iii) subsequently adding all ionic components to said polymer solution.

2. A process according to claim 1, wherein at wavelength of 410–800 nanometers, said composition has 50% transmittance of light using a 1 centimeter cuvette wherein said compositions are measured free of any dyes.

3. A process according to claim 1, wherein the gum network further comprises a polysaccharide polymer and a cationic polymer.

4. A process according to claim 1, comprising 0.1 to 10% by wt. particles having size of 300 to 5000 microns.

5. A process according to claim 4, wherein particles are 500 to 2500 microns.

6. A process according to claim 5, wherein particles are 700 to 2000 microns.

7. A process according to claim 1, comprising 5% to 50% by wt. nonionic (b).

8. A process according to claim 1, wherein component (c) is 0.1 to 10% by weight composition.

9. A process according to claim 8, comprising 10 to 40% nonionic (b).

10. A composition according to claim 1, wherein pour viscosity is 100 to 2000 cps at 21 $S^{-1}$.

11. A composition according to claim 10, wherein pour viscosity is 150 to 1500 cps at 21 $S^{-1}$.

* * * * *